US007669355B2

(12) United States Patent
Gronenthal et al.

(10) Patent No.: US 7,669,355 B2
(45) Date of Patent: Mar. 2, 2010

(54) SIMULATED BALLOON DISPLAY AND METHOD

(76) Inventors: William Gronenthal, 17 Tallyho La., Newton, NJ (US) 07860; Michael Tufaro, 6 Ridge Pl., Andover, NJ (US) 07821

( * ) Notice: Subject to any disclaimer, the term of this patent is extended or adjusted under 35 U.S.C. 154(b) by 870 days.

(21) Appl. No.: 11/375,340

(22) Filed: Mar. 15, 2006

(65) Prior Publication Data

US 2007/0218802 A1 Sep. 20, 2007

(51) Int. Cl.
*G09F 15/00* (2006.01)

(52) U.S. Cl. ..... 40/606.19; 40/661.12; 40/610; 40/607.12

(58) Field of Classification Search ..... 40/606.19, 40/607.01, 607.02, 607.03, 607.12, 661.12, 40/611.08, 737, 610
See application file for complete search history.

(56) References Cited

U.S. PATENT DOCUMENTS 3,171,626 A * 3/1965 Keats ..... 248/122.1
3,364,090 A * 1/1968 Slipp ..... 156/245
4,077,588 A 3/1978 Hurst
4,791,745 A * 12/1988 Pohn ..... 40/546
4,796,369 A * 1/1989 Hamann ..... 40/606.15
5,028,031 A * 7/1991 Stoudt ..... 40/610
5,454,178 A * 10/1995 Rivard ..... 40/124.5
6,212,805 B1 * 4/2001 Hill ..... 40/443
6,688,027 B2 * 2/2004 Fink ..... 40/611.08
6,898,883 B2 * 5/2005 Bramer ..... 40/615
7,057,530 B2 * 6/2006 Young ..... 340/908
7,090,557 B1 * 8/2006 Ainsworth et al. ..... 446/487
2005/0155265 A1 7/2005 Coleman-Chang

FOREIGN PATENT DOCUMENTS

WO WO 94/25952 11/1994

OTHER PUBLICATIONS http://brightpost.com.*

* cited by examiner

*Primary Examiner*—Lesley Morris
*Assistant Examiner*—Christopher E Veraa
(74) *Attorney, Agent, or Firm*—Thomas J. Germinario

(57) ABSTRACT

A simulated balloon display is designed to be attached to a real estate "tent sign" or used in conjunction with any other promotional presentation. A silhouette cluster made of thin translucent colored plastic mimics the appearance of free-floating balloons while avoiding the handling problems and expense involved with helium inflated balloons.

4 Claims, 3 Drawing Sheets

SIMULATED BALLOON DISPLAY AND METHOD

BACKGROUND OF THE INVENTION

Balloons are often used in advertising and other types of displays to draw the public's attention. Because of their colorful appearance and festive connotations, balloons are eye-catching features that add visual appeal to any kind of display. Such displays often serve to accentuate public announcements of a personal nature, such as the birth of a child, a party, or a yard sale. Balloon-enhanced displays also play an important role in commercial promotions, business marketing and public relations events.

Among the business applications of balloon-enhanced displays, perhaps the most notable and institutionalized is that of the real estate "Open House" sign. The "Open House" sign is used to direct potential buyers to a property location and usually features a directional indicator, such as an arrow. The customary presentation of such signs includes multiple free-floating balloons filled with helium for buoyancy. In this setting, decorative balloons are usually tied to a handle which is built into the top of a standard real estate "tent sign," as depicted in FIG. 1, which handle is also used to grasp the sign while transporting it.

For all of its advantages, however, the balloon-enhanced display has a number of serious drawbacks and problems associated with it. The process of filling balloons with helium is time consuming and can be hazardous. Helium tanks are heavy and bulky, and improperly secured tanks are prone to fall and cause injuries. Once the balloons are filled, their buoyancy makes them difficult to handle and transport. In windy or inclement weather, buoyant balloons often escape to litter the landscape. Deflated and partially deflated escaped balloons present a choking hazard to wildlife and small children.

The economies of balloon enhanced displays are also disadvantageous in several respects. Helium gas and storage tanks are expensive. Adding to the expense are the recurring costs of the balloons, stems and string or ribbon to secure them. After one use, these items are discarded. Valuable time of sales/marketing personnel is wasted in filling, transporting and deploying the balloons. At best, balloon-enhanced displays may last a few hours, after which the balloons must be replaced.

As applied to real estate salespeople's use of balloons with their "Open House" signs, the foregoing problems are magnified. On any given weekend, a typical real estate office may have thirty or more Open House events, for each of which a salesperson must place up to eight directional "tent signs" and attach the balloons. In order to fill the required balloons, the salesperson must first drive to the sales office—often out of the way of the route to the Open House—and then wait his/her turn while other salespeople fill their balloons. An hour or two of prime sales time is often wasted in this effort.

Once the balloons are filled with helium, the salesperson's problems have just begun. He/she must now shove the buoyant balloons inside his/her vehicle, where they will float around, obstructing the driver's view and diverting his/her attention from the road. After reaching his/her destination, the agent must contend with the wind and weather to keep the balloons from escaping before they are secured to the sign. Even after they are tied to the sign, the balloons are apt to pop, deflate or break loose.

Another shortcoming of an inflated balloon display is the inherent difficulty in using the ovoid balloon surface to display readable lettering and/or graphic symbols. The curvature of the balloon surface and the constant rotational motion of a free-floating balloon make it an unsuitable medium for all but the briefest scripts. This limitation particularly disadvantages the real estate salesperson, who must depend upon the compact area of the Open House sign to convey as much information to the public as possible about the listed property.

The present invention offers an inexpensive practical solution to all of the foregoing problems in the form of a simulated balloon display. The simulated balloon display presents the appearance of a cluster of free-floating balloons in the form of a flat silhouette comprising multiple overlapping ovoid or partially ovoid outlines cut out from a thin panel of durable translucent plastic with etched surface texturing to create the illusion of volume and perspective.

Since the simulated balloon display is supported by a rigid staff attached to a sign or other fixed structure, it is designed to withstand the wind and outdoor elements. Since the simulated balloon display is flat, it can be stored compactly and transported easily from place to place. Since the simulated balloon material is durable and does not require inflation, a single display can be used and re-used almost indefinitely.

The flatness of the simulated balloon surface also enables the display of messages in the form of text and/or graphic symbols, so that the simulated balloon functions as informational extension of the promotional display of which it is a part. Thus is the balloon element of the display transformed from a purely decorative device to a tool of communication.

SUMMARY OF THE INVENTION

The present invention is directed to a simulated balloon display which can be substituted for actual inflated balloons to enhance commercial promotional presentations as well as graphic public communications of any kind. The central element of the display mimics the appearance of a bunch of free-floating balloons by presenting a cluster silhouette comprising multiple ovoid and/or partial ovoid colored balloon outlines that overlap one another. The cluster silhouette is fabricated as a one-piece flat panel of durable translucent plastic, preferably 1/10" to 1/5" (100 to 200 mils) in thickness, and comprises a front surface and a back surface. On the front surface of the cluster silhouette are one or more sets of tracks into which one or more message panels containing text and/or graphic content are slidably inserted. The message panels can be made of transparent or translucent plastic with opaque lettering/graphics, or they can be an opaque material, such as vinyl plastic or cardboard. Alternately, blank message panels of either variety can be used, thus allowing new content to be written therein with paint, ink or marker.

In order to foster the illusion that the flat balloon outlines have volume, the front surface of the cluster silhouette is etched to create a texture that refracts light in the same way as do inflated balloons. The back surface can be similarly etched to increase the refraction effect. In order to foster the illusion of perspective, a balloon outline appearing to float "behind" the other balloon outlines in the cluster silhouette is etched with a more shallow texture than the others or is etched only on the front surface, so that its refracted light is diminished, thereby giving the visual impression of a balloon floating at a greater distance from the viewer.

The illusion of free-floating balloons is further enhanced by multiple balloon strings, preferably consisting of a 6" to 12" lengths of narrow plastic cord or ribbon, attached to the bottom terminus of each of the balloon outlines comprising the cluster silhouette. The undulating movement of colorful balloon strings in the wind further serves to draw attention to the display.

The simulated balloon cluster silhouette is supported by a staff, preferably ¼" to ⅜" in diameter and 16" to 24" in length, fabricated of translucent plastic. Optimally, the staff should be rigid enough not to bend in a strong wind, yet flexible enough to sway somewhat in the breeze, thus imparting to the cluster silhouette an oscillating motion suggestive of free-floating balloons.

In the preferred embodiment, the staff is permanently affixed at its upper end to the back surface of the cluster silhouette at the approximate midpoint of its width. Alternately, the staff can be removably attached at its upper end to the back surface of the cluster silhouette. In either case, the staff is attached through one or more receiving structures, such as channels, slots, grooves or extruded sockets, in the back surface of the cluster silhouette. In the preferred embodiment, the upper end of the staff has a notched or projecting element which fits into a conjugate projecting or notched element in one of the receiving structures in the back surface of the cluster silhouette, such that the cluster silhouette cannot rotate around the axis of the staff. Alternately, the notched/projecting elements can be deleted so as to allow the cluster silhouette to rotate freely about the staff.

The staff at its lower end is removably inserted into a socket in a clamp which is affixable to the top of a sign or other structure associated with the display. To prevent rotation of the staff in the socket, the lower end of the staff has a notched or projecting element which fits into a conjugate projecting or notched element in the socket. In the preferred embodiment, the clamp is designed to be secured to a carrying handle of a real estate "tent sign." A typical "tent sign," as depicted in FIGS. 1 and 2, comprises two rectangular sign panels hingeably connected along a top horizontal edge of each sign panel, with a carrying handle incorporated into the top horizontal edge of one of the sign panels.

In the preferred embodiment, the clamp is integrally fabricated of molded plastic or die-cast aluminum and comprises a staff support, a base plate, a forward arm, an extension arm, a handle channel and a linchpin. The staff support is an upwardly protruding structure, preferably 1¾" to 2" in height and ⅝" to ¾" in diameter, containing an axially disposed socket having a diameter slightly larger than that of the staff and a depth sufficient to secure the lower end of the staff, preferably 1½" to 2". As stated earlier, the lower end of the staff and the socket have conjugate projecting and notched elements to prevent rotation of the shaft.

In the clamp beneath the staff support is the base plate, which is rectangular, preferably 3/16" to ¼" thick, 4" to 5" in length and ⅝" to ¾" in width, having two lengthwise sides consisting of a forward side and a rear side. Extending perpendicularly downward from the forward side is the forward arm, which is rectangular, ⅛" to 3/16" in thickness of the same length as the base plate and 1" to 1½" in width. Extending perpendicularly downward from the rear side of the base plate is the extension arm, which is rectangular, of the same thickness and length as the base plate and 2" to 2½" in width. Below the base plate between the forward arm and the extension arm is a handle channel, which is preferably ¼" to ⅜" in width and 1" to 1 ¼" in depth. The forward arm and the extension arm each have mutually aligned openings through which a linchpin can be horizontally inserted.

In its application to a real estate "Open House," the simulated balloon display is set up as follows: (1) the "tent sign" is opened and placed at the appropriate location; (2) the extension arm of the clamp is inserted downward between the two sign panels of the tent sign; (3) the handle channel of the clamp is placed over the handle of the tent sign so that the base plate rests atop the handle; (4) the linchpin is inserted through the aligned openings in the forward arm and extension arm so that it passes beneath the handle of the tent sign and secures it within the handle channel; (5) if the staff is not permanently attached to the cluster silhouette, the upper end of the staff is inserted into the receiving structures in the back surface of the cluster silhouette, with the notched or projecting element on the upper end of the staff conjugately fitted into the corresponding element of the receiving structures; (6) the staff with the cluster silhouette attached to its upper end is inserted by its lower end into the socket of the clamp with the notched or projecting element of the lower end of the staff conjugately fitted into the corresponding element of the socket; (7) one or more message panels are inserted into the set(s) of tracks on the front surface of the cluster silhouette.

Therefore, the present invention provides the apparatus and methodology to quickly, safely and economically set up a balloon-enhanced advertising or promotional display while avoiding the difficulties and deficiencies associated with the use of helium-inflated balloons. Moreover, the simulated balloon display is functionally superior to a similar inflated balloon display because it enables promotional messages, information and/or graphics to be readably displayed on the surface of the simulated balloons, which is much less feasible and practicable with inflated balloons.

DESCRIPTION OF THE INVENTION

Figure 1:
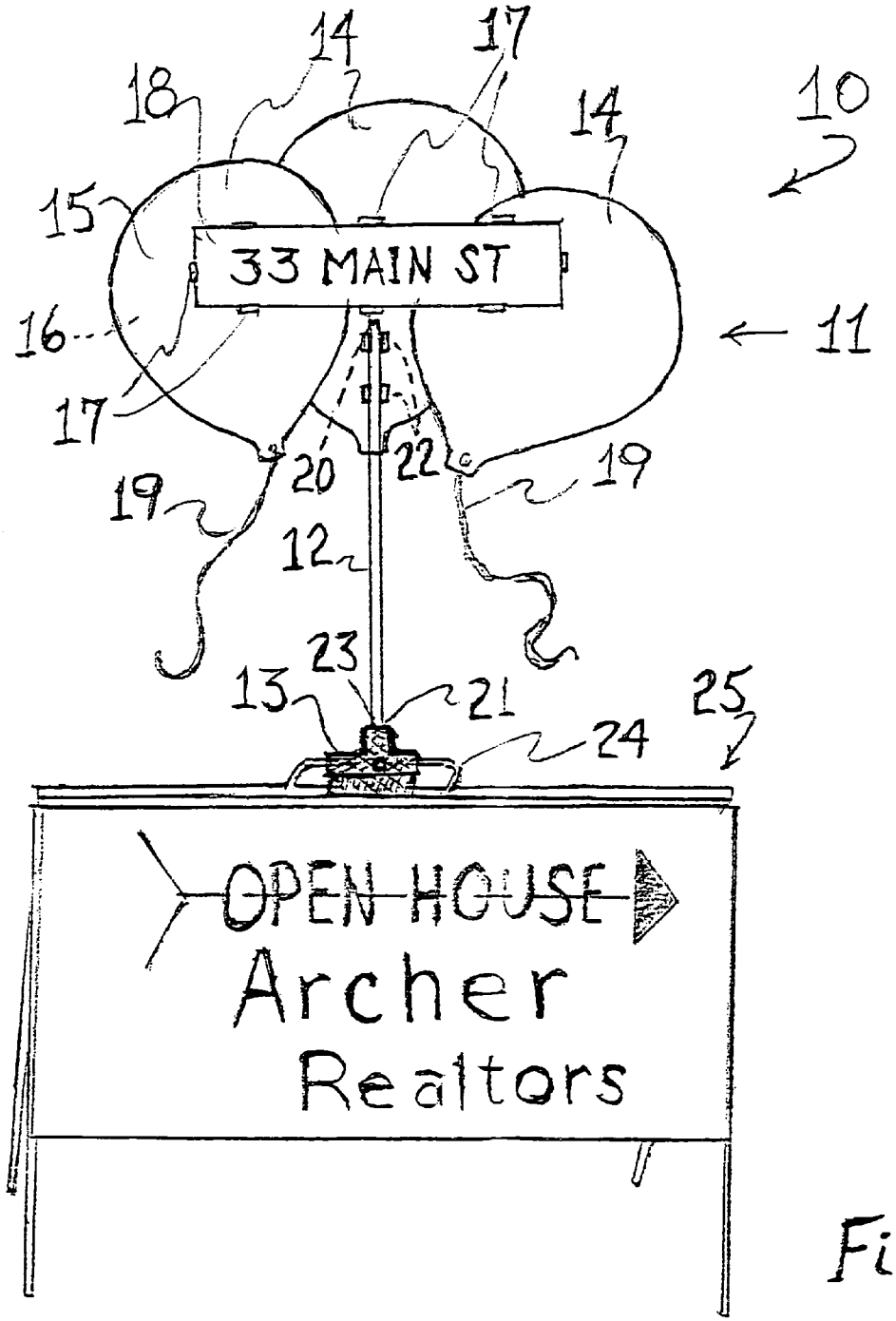
FIG. 1 is a front elevation view of the simulated balloon display attached to a real estate "tent sign."
Figure 2:
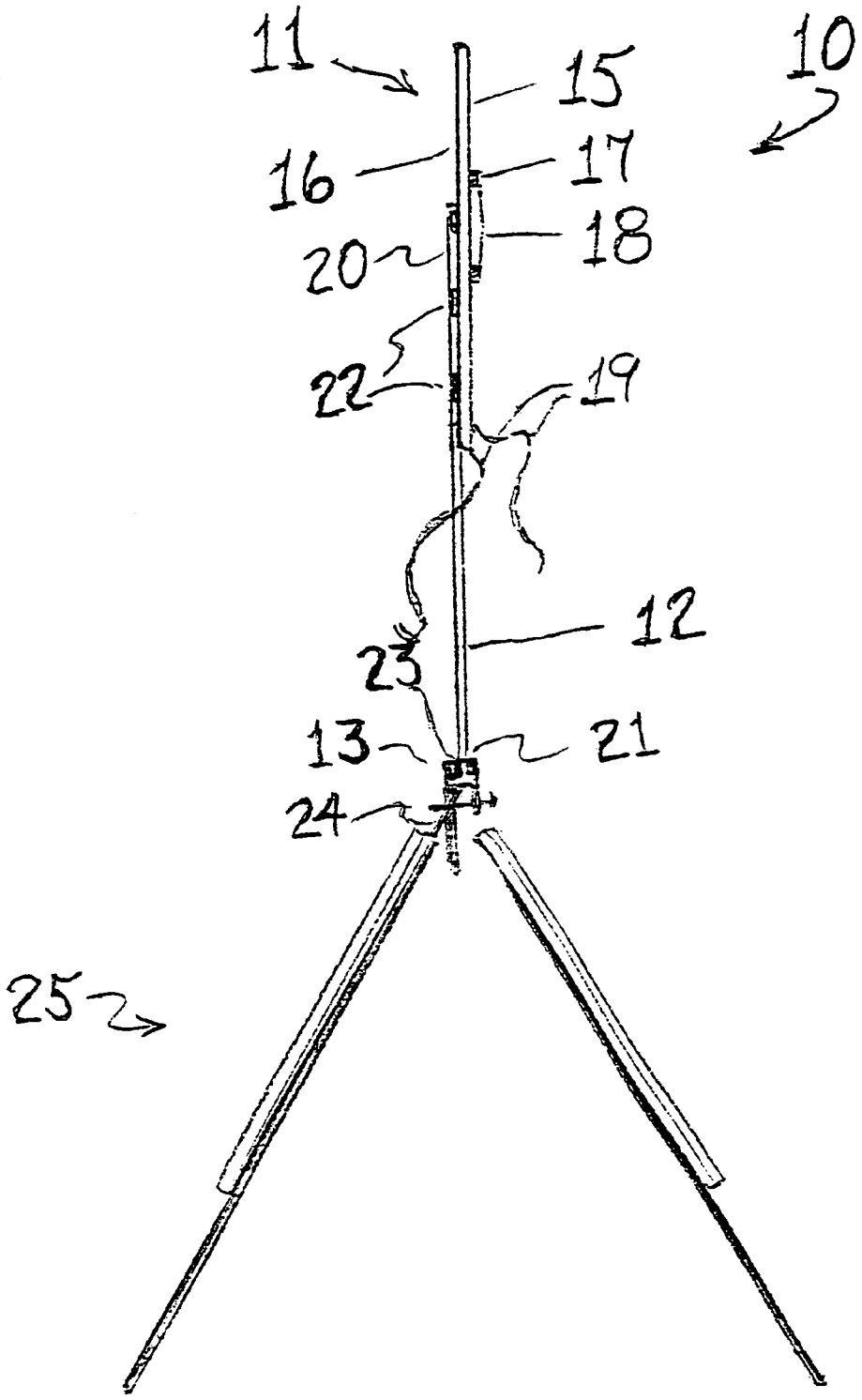
FIG. 2 is a left side elevation view of the simulated balloon display attached to a real estate "tent sign."

As shown is FIG. 1, a simulated balloon display according to the present invention 10 comprises a cluster silhouette 11, a staff 12 and a clamp 13. The cluster silhouette 11 is fabricated as a one-piece flat panel of durable translucent plastic and comprises multiple balloon outlines 14. The balloon outlines 14 are ovoid or partially ovoid in shape and overlap one another, giving the appearance of a cluster of free-floating colored balloons. In the preferred embodiment, the cluster silhouette is 1/10" to ⅕" (100 mil to 200 mils) in thickness.

The cluster silhouette has a front surface 15 and a back surface 16. On the front surface 15 are one or more sets of tracks 17 into which one or more message panels 18 containing text and/or graphic content are slidably and interchangeably inserted. The message panels 18 can be made of transparent or translucent plastic with opaque lettering/graphics, or they can be an opaque material, such as vinyl plastic or cardboard. Alternately, blank message panels of either variety can be used, thus allowing new content to be written thereon with paint, ink or marker.

The front surface 15 of the cluster silhouette 11 is etched to create a texture that refracts light in the same way as do inflated balloons. The back surface can be similarly etched to increase the refraction effect. In the preferred embodiment, the balloon outlines 14 appearing to float "behind" the other balloon outlines 14 in the cluster silhouette 11 are etched with a more shallow texture than the others or are etched only on the front surface, so that their refracted light is diminished, thereby giving the visual impression of a balloon floating at a greater distance from the viewer. Multiple balloon strings, preferably consisting of a 6" to 12" lengths of narrow plastic cord or ribbon, are attached to the bottom terminus of each of the balloon outlines 14 comprising the cluster silhouette 11.

The cluster silhouette 11 is supported by a staff 12, preferably ¼" to ⅜" in diameter and 16" to 24" in length, fabricated of opaque or translucent plastic. The staff 12 has an upper end 20 and a lower end 21. Optimally, the staff 12 should be rigid enough not to bend in a strong wind, yet flexible enough to sway somewhat in the breeze. In the preferred embodiment, the staff 12 is permanently affixed at its upper end to the back surface 16 of the cluster silhouette 11 at the approximate midpoint of its width. Alternately, the staff 12 can be removably attached at its upper end 20 to the back surface 16 of the cluster silhouette 11. In either case, the staff is attached through one or more receiving structures 22, such as channels, slots, grooves or extruded sockets, in the back surface of the cluster silhouette. In the preferred embodiment, the upper end 20 of the staff 12 has a notched or projecting element (not shown) which fits and locks into a conjugate projecting or notched element (not shown) in one of the receiving structures in the back surface 16 of the cluster silhouette 11 such that the cluster silhouette 11 cannot rotate around the axis of the staff 12. Alternately, the notched/projecting elements are not present, and the cluster silhouette 11 is free to rotate about the staff 12.

The staff 12 at its lower end 21 is removably inserted into a socket 23 in the clamp 13 which is affixable to the top of a sign or other structure associated with the display. To prevent rotation of the staff 12 in the socket 23, the lower end 21 of the staff 12 has a notched or projecting element (not shown) which fits into a conjugate projecting or notched element (not shown) in the socket 23. In the preferred embodiment, the clamp 13 is designed to be secured to a carrying handle 24 of a real estate "tent sign" 25.

Figure 3A:
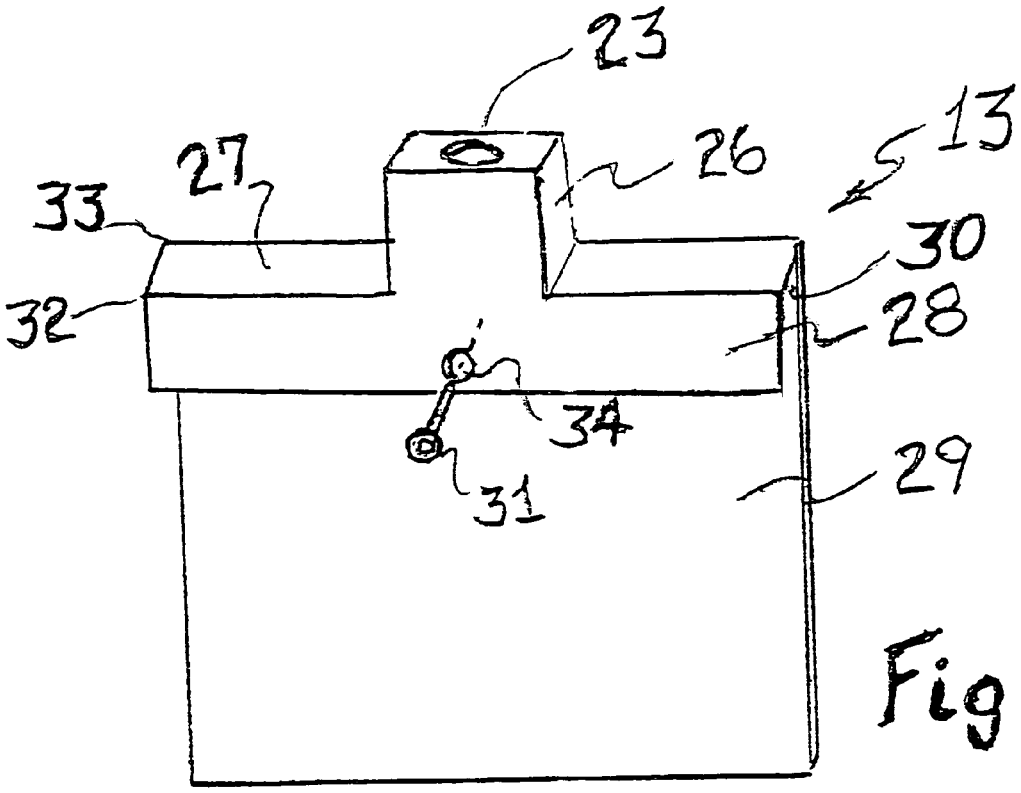
FIG. 3*a* is a front perspective view of the clamp which attaches to a real estate "tent sign."
Figure 3B:
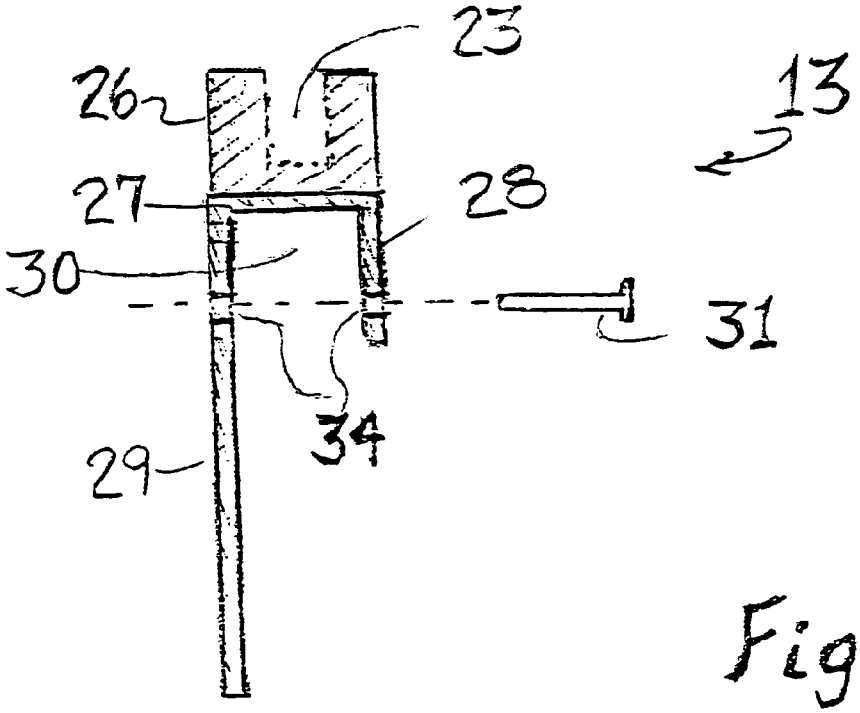
FIG. 3*b* is a left side cross-sectional view of the clamp which attaches to a real estate "tent sign."

Referring to FIGS. 3*a* and 3*b*, in the preferred embodiment, the clamp 13 is integrally fabricated of molded plastic or die-cast aluminum and comprises a staff support 26, a base plate 27, a forward arm 28, an extension arm 29, a handle channel 30 and a linchpin 31. The staff support 26 is an upwardly protruding structure, preferably 1¾" to 2" in height and ⅝" to ¾" in diameter, containing an axially disposed socket 23. The socket 23 has a diameter slightly larger than that of the staff 12 and a depth sufficient to secure the lower end of the staff 21, preferably 1½" to 2". As stated earlier, the lower end of the staff 21 and the socket 23 have conjugate projecting and notched elements (not shown) to prevent rotation of the shaft.

In the clamp 13 beneath the staff support 26 is the base plate 27, which is rectangular, preferably 3/16" to ¼" thick, 4" to 5" in length and ⅝" to ¾" in width, having two lengthwise sides consisting of a forward side 32 and a rear side 33. Extending perpendicularly downward from the forward side 32 is the forward arm 28, which is rectangular, ⅛" to 3/16" in thickness, of the same length as the base plate 27, and 1" to 1½" in width. Extending perpendicularly downward from the rear side 33 of the base plate 27 is the extension arm 29, which is rectangular, of the same thickness and length as the base plate and 2" to 2½" in width. Below the base plate 27 between the forward arm 28 and the extension arm 29 is a handle channel 30, which is preferably ¼" to ¾" in width and 1" to 1¼" in depth. The forward arm 27 and the extension arm 28 each have mutually aligned openings 34 through which the linchpin 31 can be horizontally inserted.

In its application to a real estate "Open House," the simulated balloon display 10 is set up as follows: (1) the "tent sign" 25 is opened and placed at the appropriate location; (2) the extension arm 29 of the clamp 13 is inserted downward between the two sign panels of the tent sign; (3) the handle channel 30 of the clamp 13 is placed over the handle 24 of the tent sign 25 so that the base plate 27 rests atop the handle 24; (4) the linchpin 31 is inserted through the aligned openings 34 in the forward arm 28 and extension arm 29 so that it passes beneath the handle 24 of the "tent sign" and secures it within the handle channel 30; (5) if the staff 12 is not permanently attached to the cluster silhouette 11, the upper end of the staff 20 is inserted into the receiving structures 22 in the back surface 16 of the cluster silhouette 11 with the notched or projecting element (if present) on the upper end of the staff 20 conjugately fitted into the corresponding element of the receiving structures 22; (6) the staff 12 with the cluster silhouette 11 attached to the upper end 20 is inserted by the lower end 21 into the socket 23 of the clamp 13 with the notched or projecting element of the lower end of the staff 21 conjugately fitted into the corresponding element of the socket 23; (7) one or more message panels 18 are inserted into the set(s) of tracks 17 on the front surface 15 of the cluster silhouette 11.

While the present invention has been described in some detail with reference to certain currently preferred embodiments, other embodiments are feasible and will readily suggest themselves to those skilled in the art. Therefore, the spirit and scope of the appended claims are not limited to the description of the preferred embodiment contained herein.

What is claimed is:

1. A simulated balloon display comprising:

(a) a cluster silhouette, which consists of a one-piece flat panel of durable translucent colored plastic; the cluster silhouette has a front surface and a back surface, and within the cluster silhouette are etched multiple overlapping balloon outlines, each having an ovoid or partially ovoid shape, wherein the front surface and/or the back surface of the cluster silhouette is/are etched so as to create a texture that refracts lights in a manner simulating the refraction of light through an inflated balloon;

(b) a staff by which the cluster silhouette is supported in an upright position, which staff has an upper end that is attached to the back surface of the cluster silhouette and a lower end; and (c) a clamp which is attachable to a freestanding, portable "tent sign," which "tent sign" has two sign panels hingeably attached to one another and a handle by which the sign is carried from place to place, wherein the clamp comprises: (i) a socket into which the lower end of the staff is inserted, (ii) a forward arm that fits over the handle of the tent sign, (ii) a handle channel within which the handle can be secured, and (iii) an extension arm that extends downward between the two faces of the "tent sign."

2. The simulated balloon display according to claim 1, wherein there are mutually aligned openings in the forward arm and the extension arm through which a linchpin is inserted through the handle channel beneath the handle of the "tent sign" to better secure the handle within the handle channel.

3. The simulated balloon display according to claim 2, wherein the balloon outlines that are overlapped by one or more other balloon outlines are etched with a more shallow texture than are the overlapping balloon outlines or are etched only on the front or back surface, such that the overlapped balloon outlines refract less light and thus give the visual impression of being more distant from the viewer.

4. The simulated balloon display according to claim 3, wherein the front surface of the cluster silhouette has one or more sets of tracks into which one or more message panels containing or capable of containing text and/or graphic content are slidably and interchangeably inserted.

* * * * *